US005961294A

United States Patent [19]

Hataura et al.

[11] Patent Number: 5,961,294

[45] Date of Patent: Oct. 5, 1999

[54] METHOD FOR ATTACHING A FUEL INJECTION DEVICE TO AN ENGINE AND FUEL INJECTION DEVICE

[75] Inventors: Kiyoshi Hataura; Osamu Takii; Hiroshi Mikumo, all of Sakai, Japan

[73] Assignee: Kubota Corporation, Osaka, Japan

[21] Appl. No.: 08/848,744

[22] Filed: May 1, 1997

[30] Foreign Application Priority Data

May 2, 1996 [JP] Japan ..... 8-111365

[51] Int. Cl.[6] ..... F04B 17/00

[52] U.S. Cl. ..... 417/53; 29/156.4 R

[58] Field of Search ..... 29/888.02, 893.2, 29/523, 420, 447, 888.01; 418/206; 123/90.34; 103/41; 417/53

[56] References Cited

U.S. PATENT DOCUMENTS

| | | | |
|---|---|---|---|
| 2,414,518 | 1/1947 | Garday | 103/41 |
| 3,962,772 | 6/1976 | Haller | 29/420 |
| 3,999,277 | 12/1976 | Hamada | 29/447 |
| 4,123,835 | 11/1978 | Itoh et al. | 29/156.4 R |
| 4,280,454 | 7/1981 | Skinner | 123/195 A |
| 4,348,895 | 9/1982 | Straubel et al. | 73/119 A |

FOREIGN PATENT DOCUMENTS

| | | |
|---|---|---|
| 57-171068 | 10/1982 | Japan . |
| 01167455 | 7/1989 | Japan . |
| 2-161164 | 6/1990 | Japan . |
| 8326626 | 12/1996 | Japan . |
| 9-32691 | 2/1997 | Japan . |
| 2 026 599 | 1/1980 | United Kingdom . |

*Primary Examiner*—Charles G. Freay
*Assistant Examiner*—Robert Z. Evora
*Attorney, Agent, or Firm*—Bacon & Thomas, PLLC

[57] ABSTRACT

A fuel injection device 23 adapted to be attached to an engine and provided with a pump case 1, a fuel injection pump 2, a fuel injection cam shaft 3, a connecting portion 5, an input end portion 6 of the fuel injection cam shaft 3 and a temporary holding means 10 is employed and the following procedures are carried out. Both, revolution of the fuel injection cam shaft 3 and of a crankshaft 17 is stopped. The pump case 1 is connected to an engine timing gear case 8, and engagements for a timing gear train 43 are carried out. Play in the timing gear train 43 is removed during the turning of the pump case 1 and the pump case 1 is fixedly secured to the timing gear case 8. Thereafter, of the fuel injection cam shaft 3 and the crankshaft 17 are released and allowed rotate.

11 Claims, 7 Drawing Sheets

METHOD FOR ATTACHING A FUEL INJECTION DEVICE TO AN ENGINE AND FUEL INJECTION DEVICE

BACKGROUND OF THE INVENTION

1. Filed of the Invention

The present invention relates to a method for attaching a fuel injection device to an engine and a fuel injection device.

2. Description of Earlier Technology

Prior to this invention, the inventors of this invention manufactured a fuel injection device adapted to be attached to an engine as shown in FIG. 8. This fuel injection device 123 has the following construction.

This fuel injection device 123 is provided with a pump case 101, a fuel injection pump 102 fixedly secured to the pump case 101, a fuel injection cam shaft 103 bridged within the pump case 101, a connecting portion 105 arranged in an end wall 104 of the pump case 101, and an input end portion 106 of the fuel injection cam shaft 103 projecting from the connecting portion 105.

The pump case 101 is connected at its connecting portion 105 to an engine timing gear case 108. A fuel injection cam gear 107 is fixedly secured to an input end portion 106 of the fuel injection cam shaft 103 in a predetermined position. The pump case 101 connected to the timing gear case 108 is turned about the fuel injection cam shaft 103. When the pump case 101 has stopped its revolution, it is fixedly secured to the timing gear case 108.

The inventors of this invention attached the above-mentioned device 123 to the engine as follows.

The pump case 101 is attached at its connecting portion 105 to the engine timing gear case 108. The fuel injection cam gear 107 is fixedly secured to the input end portion 106 of the fuel injection cam shaft 103 in a predetermined position. The fuel injection cam gear 107 is engaged with an interlocking gear 116 of a crankshaft gear 115 in a predetermined position. Gears of a timing gear train 143 extending from the crankshaft gear 115 to the fuel injection cam gear 107 are mutually engaged with each other by coinciding marks 114 provided in the respective gears.

Differently from this invention, the above-mentioned device 123 is not provided with a means for temporarily stopping revolution of the fuel injection cam shaft 103. Therefore, when attaching this device 123 to the engine, it is necessary to set a fuel injection start timing after the connecting of the pump case 101 to the engine timing gear case 108.

The setting of the fuel injection start timing is carried out as follows.

First, the pump case 101 is temporarily attached to the timing gear case 108 in an arbitrary position. Then, while the crankshaft 117 is turned slowly by hand, a fuel oil level at a fuel delivery port (not illustrated) of the fuel injection pump 102 is observed visually. The time when the fuel oil surface starts to swell is defined as a fuel injection start timing, and at this time, the turning of the crankshaft 117 is stopped. Next, a crank angle is read with reference to a graduation 144 of a flywheel 136 shown by a pointer 146 of a flywheel cover 145 to measure the fuel injection start timing. Then, in order to bring the measured injection start timing to a target value, the temporary attachment of the pump case 101 is released to turn the pump case 101. The position of the fuel injection pump 102 with respect to the fuel injection cam shaft 103 is corrected by this turning and the pump case 101 is then temporarily held. After that, the measuring of the fuel injection start timing and the correcting of the position of the fuel injection pump 102 are repeated until the fuel injection start timing reaches the target value.

There are, however, the following problems accompanied with the above-mentioned earlier technology.

In the above-mentioned earlier technology, the fuel injection start timing is measured based on the visual observation of the starting of the fuel oil surface swelling at the fuel delivery port of the fuel injection pump 102. However, this observation method lacks correctness and is low in measurement accuracy of the injection start timing. Lash or play in the timing gear train 143, caused by gaps between mating or meshed gear teeth, results in lower measurement accuracy of the injection start timing. Since the measurement accuracy of the injection start timing is low, the injection start timing can't be set accurately.

In the above-mentioned earlier technology, the injection start timing is set after the pump case 101 has been connected to the engine timing gear case 108. Since the measurement of the injection start timing and the correction of the position of the fuel injection pump 102 are repeated during that setting, the setting time is relatively long. After the position of the fuel injection pump 102 has been established by that setting, a fuel injection pipe is connected to the fuel injection pump 102. Since the setting of the injection start timing must be accomplished between the connecting of the pump case 101 and the connecting of the fuel injection pipe, the engine assembly must be interrupted for a comparatively long time and the engine assembly becomes stagnated.

SUMMARY OF THE INVENTION

An object of this invention is to provide a method for attaching a fuel injection device to an engine in which a fuel injection start timing can be set accurately without the engine assembly becoming stagnated.

A construction of the inventive method for attaching a fuel injection device to an engine is as follows.

A fuel injection device 23, which is adapted to be attached to an engine and which includes a pump case 1, a fuel injection pump 2 fixedly secured to the pump case 1, a fuel injection cam shaft 3 spanning the pump case 1, a connecting portion 5 arranged in an end wall 4 of the pump case 1, an input end portion 6 of the fuel injection cam shaft 3 projecting from the connecting portion 5, and a temporary holding means 10 arranged in the pump case 1, is employed.

A revolution of the fuel injection cam shaft 3 is temporarily stopped and a revolution of a crankshaft 17 is temporarily stopped.

When temporarily stopping the revolution of the fuel injection cam shaft 3, the fuel injection cam shaft 3 is temporarily held with the pump case 1 in a predetermined position by temporarily preventing a forward revolution 3*a* and a reverse revolution 3*b* of the fuel injection cam shaft 3 by the temporary holding means 10.

When temporarily stopping the revolution of the crankshaft 17, the crankshaft 17 is temporarily held with the engine in a predetermined position.

The pump case 1 is connected at its connecting portion 5 to an engine timing gear case 8. A fuel injection cam gear 7 is fixed to the input end portion 6 of the fuel injection cam shaft 3 in a predetermined position. The fuel injection cam gear 7 is engaged with a crankshaft gear 15, or its interlocking idler gear 16, in a predetermined position.

The pump case 1 connected to the timing gear case 8 is turned about the fuel injection cam shaft 3 in the same direction 19 as the reverse revolution 3*b*. The turning of the pump case 1 is stopped when play is removed in timing gear train 43, including the crankshaft gear 15, idler gear 16 and fuel injection cam gear 7. Then the pump case 1 in that stopped position is fixed to the timing gear case 8.

The temporary stopping of the revolutions of the fuel injection cam shaft 3 and the crankshaft 17 is terminated.

Incidentally, the positions of the fuel injection cam shaft 3 and the crankshaft 17 to be temporarily held are determined as follows. When a type of engine to which the fuel injection device 23 is attached and a target value for the injection start timing are determined, relative positions of the crankshaft 17, the fuel injection cam shaft 3 and the fuel injection pump 2 are determined by an actual measurement of a calculation. Therefore, when the fuel injection device 23 is attached to the engine, the positions of the fuel injection cam shaft 3 and the crankshaft 17 to be temporarily held are known so that the aforementioned relative positions can be established. The forward revolution 3*a* of the fuel injection cam shaft 3 has a direction along which the crankshaft 17 and the fuel injection cam shaft 3 can be interlocked during the engine operation. The reverse revolution 3*b* has a direction reverse to the forward revolution 3*a*.

The above-mentioned inventive method presents the following advantages.

According to the above-mentioned inventive method, the position of the fuel injection cam shaft 3 to be temporarily held can be set accurately and can be maintained reliably. Also, the position of the crankshaft 17 to be temporarily held can be set accurately. Further, play in the timing gear train 43 can be removed so that the temporarily held position of the fuel injection cam shaft 3 does not deviate. For these reasons, the fuel injection timing can be set accurately by the above-mentioned inventive method.

According to the above-mentioned inventive method, the temporarily holding of the fuel injection cam shaft 3 during the injection start timing setting allows the setting of the injection start timing to be accomplished separately from the engine assembly. Thus, other tasks can be accomplished in a comparatively short time during the engine assembly.

Therefore, the engine assembly isn't delayed.

A construction of the invention of a fuel injection device adapted to be attached to an engine is as follows.

A fuel injection device 23 is provided with a pump case 1, a fuel injection pump 2 fixedly secured to the pump case 1, a fuel injection cam shaft 3 spanning the pump case 1, a connecting portion 5 arranged in an end wall 4 of the pump case 1, and input end portion 6 of the fuel injection cam shaft 3 projecting from the connecting portion 5, and a temporary holding means 10 arranged in the pump case 1.

The fuel injection cam shaft 3 is temporarily received by the pump case 1 in a predetermined position by temporarily preventing a forward revolution 3*a* and a reverse revolution 3*b* of the fuel injection cam shaft 3 by the temporary holding means 10.

The pump case 1 is connected at its connecting portion 5 to an engine timing gear case 8. A fuel injection cam gear 7 is fixedly secured to the input end portion 6 of the fuel injection cam shaft 3 in a predetermined position. The pump case 1 connected to the timing gear case 8 is turned about the fuel injection cam shaft 3. When the pump case 1 has stopped its revolution, it is fixedly secured to the timing gear case 8.

BRIEF DESCRIPTION OF THE DRAWINGS

FIG. 1 is a partial sectional view of a fuel injection device attached to an engine according to a first embodiment of the present invention, in which

FIG. 2 is a partial sectional view of the fuel injection device according to the first embodiment of the present invention, in which

FIG. 4 is a partial sectional view of a fuel injection device attached to an engine according to a second embodiment of the present invention, in which

FIG. 5 is a view of the fuel injection device according to the second embodiment of the present invention, in which

FIG. 8 is a partial sectional view of a fuel injection device attached to an engine according to an earlier technology, in which

DESCRIPTION OF THE PREFERRED EMBODIMENTS

Figure 1A:
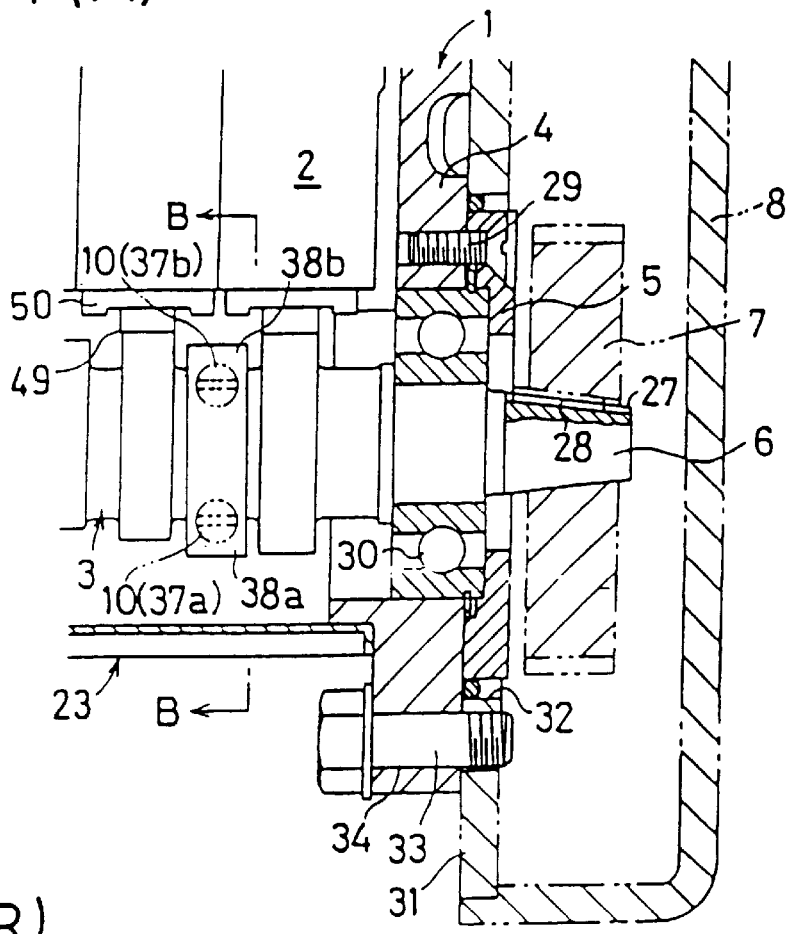
FIG. 1(A) is a vertical sectional view of a principal portion of the fuel injection device attached to a timing gear case and FIG. 1(B) is a sectional view taken along the B—B line in FIG. 1(A)

Embodiments of the present invention will be explained with reference to the drawings. FIGS. 1 through 3 are views of the first embodiment of the present invention. This embodiment relates to a fuel injection device and a method for attaching this device to an engine.

FIG. 3 shows a diesel engine equipped with a fuel injection device. A construction of this engine is as follows.

A flywheel cover 45 is attached to a rear portion of a crankcase 20 and accommodates a flywheel 36 therein. A timing gear case 8 is attached to a front portion of the crankcase 20 and an engine cooling fan 21 is attached to a front portion of this timing gear case 8. One end portion 22 of this timing gear case 8 is projected laterally from a side wall of the crankcase 20. The fuel injection device 23 is attached to a rear portion of this projected end portion 22. A governor portion 24 is attached to a rear portion of the fuel injection device 23.

FIGS. 1 and 2 show the fuel injection device. A construction of this fuel injection device 23 is as follows.

The fuel injection device 23 is provided with a pump case 1, a fuel injection pump 2 fixedly secured to the pump case 1, a fuel injection cam shaft 3 spanning the pump case 1, a connecting portion 5 arranged in an end wall 4 of the pump case 1, an input end portion 6 of the fuel injection cam shaft 3 projecting form the connecting portion 5, and a pair of male screw rods 37*a*, 37*b* threadably movably passing through a wall 11 of the pump case 1. This pair of male screw rods 37*a*, 37*b* comprise a temporary holding means 10 for the fuel injection cam shaft 3.

The fuel injection cam shaft 3 is temporarily received by the pump case 1 in a predetermined position by bringing leading ends of the pair of male screw rods 37*a*, 37*b* into contact with the fuel injection cam shaft 3 and preventing the forward revolution 3*a* of the fuel injection cam shaft 3 by one of the male screw rods 37*a* and the reverse revolution 3*b* by the other of the male screw rods 37*b*.

The pump case 1 is connected at its connecting portion 5 to an engine timing gear case 8. A fuel injection cam gear 7 is fixedly secured to the input end portion 6 of the fuel injection cam shaft 3 in a predetermined position. The pump case 1 connected to the timing gear case 8 is turned about the fuel injection cam shaft 3. When the pump case 1 has stopped its revolution, it is fixedly secured to the timing gear case 8.

Details of the above-mentioned construction are as follows.

Figure 2A:
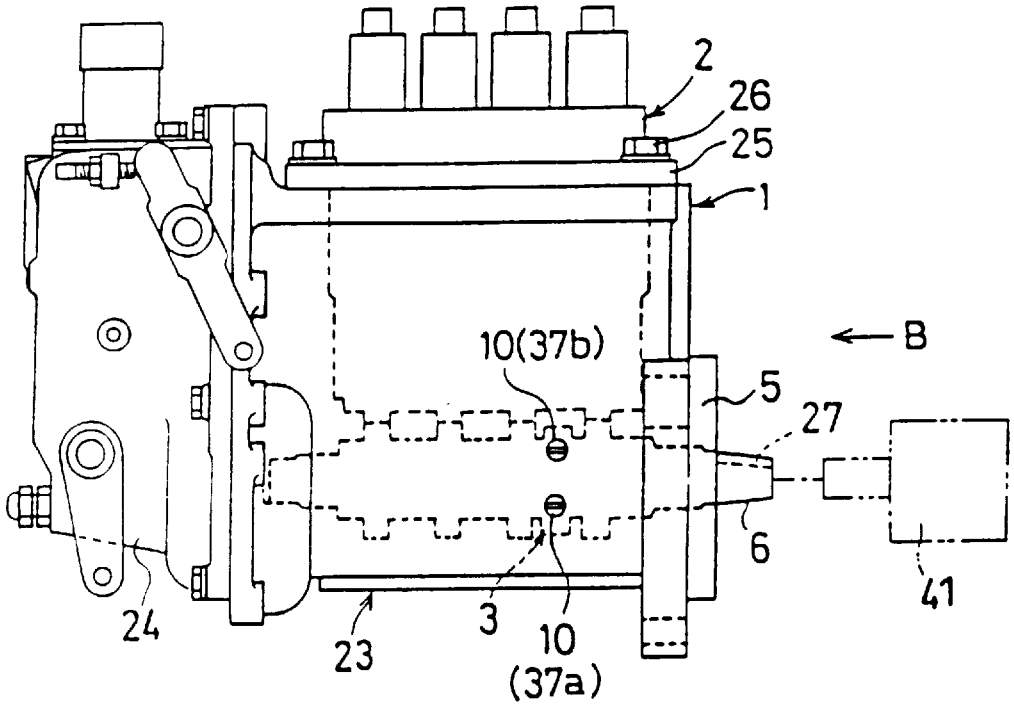
FIG. 2(A) is a side view of the fuel injection device and FIG. 2(B) is a front view of the fuel injection device.

As shown in FIG. 2, the fuel injection pump 2 is arranged side by side. In order to fix the fuel injection pump 2 to the pump case 1, the fuel injection pump 2 is inserted into the pump case 1 from above and fixedly secured at its flange portion 25 to the pump case 1 by pump attaching bolts 26. In order to support the fuel injection cam shaft 3 within the pump case 1, as shown in FIG. 1(A), bearings 30 are disposed in end walls 4 of the pump case 1 to support the fuel injection cam shaft 3 thereby. Tappets 50 of the fuel injection pump 3 are brought into contact with cam surfaces 49 of the fuel injection cam shaft 3. The connecting portion 5 of the pump case 1 is fixedly secured to the end wall 4 of the pump case 1 by screws 29.

Figure 1B:
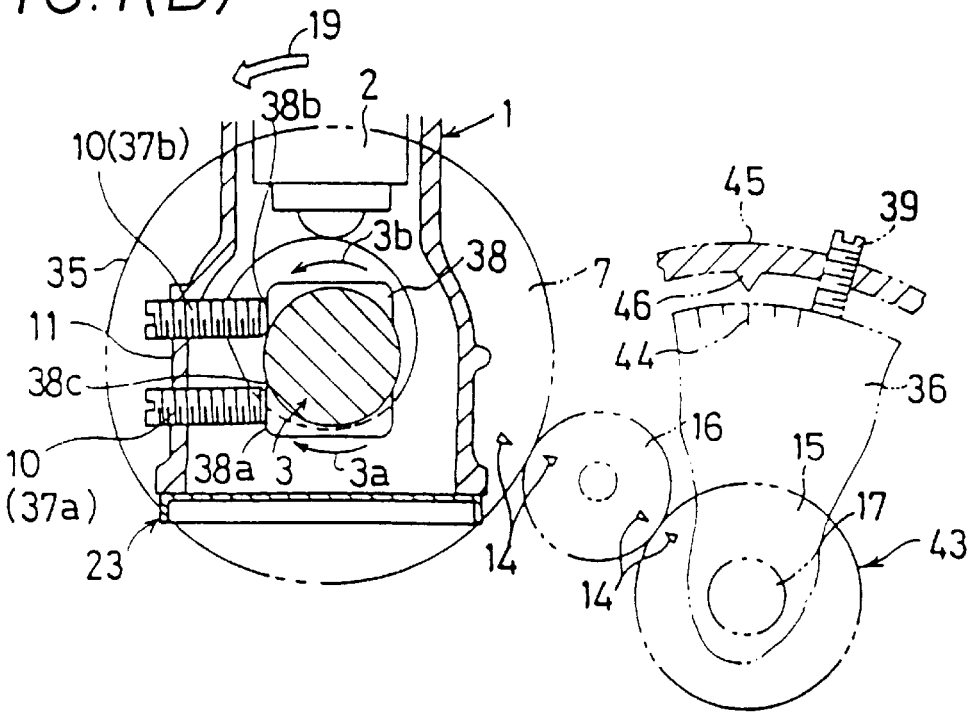

As shown in FIG. 1(B), the pair of male screw rods 37*a*, 37*b* pass through a wall 11 on one of the lateral sides of the pump case 1 in parallel. An engagement block 38, in the shape of a rectangular parallel-piped, is formed in the fuel injection cam shaft 3. The leading ends of the pair of male screw rods 37*a*, 37*b* are brought into contact with a pair of locations 38*a*, 38*b* positioned at opposite end portions of a flat surface 38*c* of this engagement block 38.

As shown in FIG. 1(A), in order to enable the pump case 1 to be rotatably connected to the timing gear case 8, the connecting portion 5 is fitted into a fitting hole 32 formed in a back plate 31 of the timing gear case 8. In order to enable a fuel injection cam gear 7 to be fixedly secured to an input end portion 6 of the fuel injection cam shaft 3 in a predetermined position, a keyway 27 is formed in the input end portion 6 so as to fix the fuel injection cam gear 7 therein by a key 28.

Figure 2B:
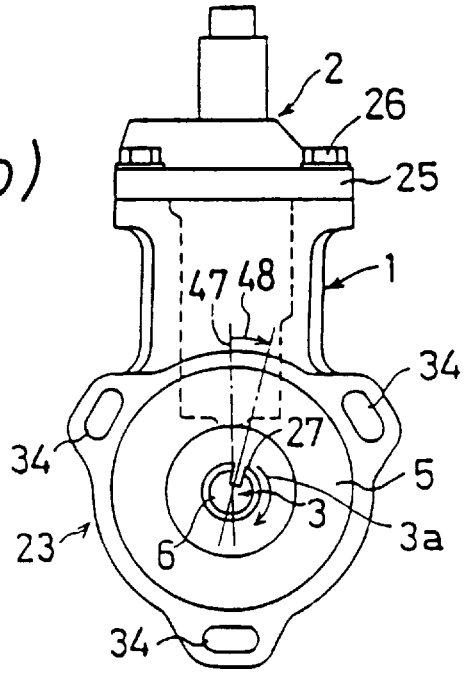
Figure 3:
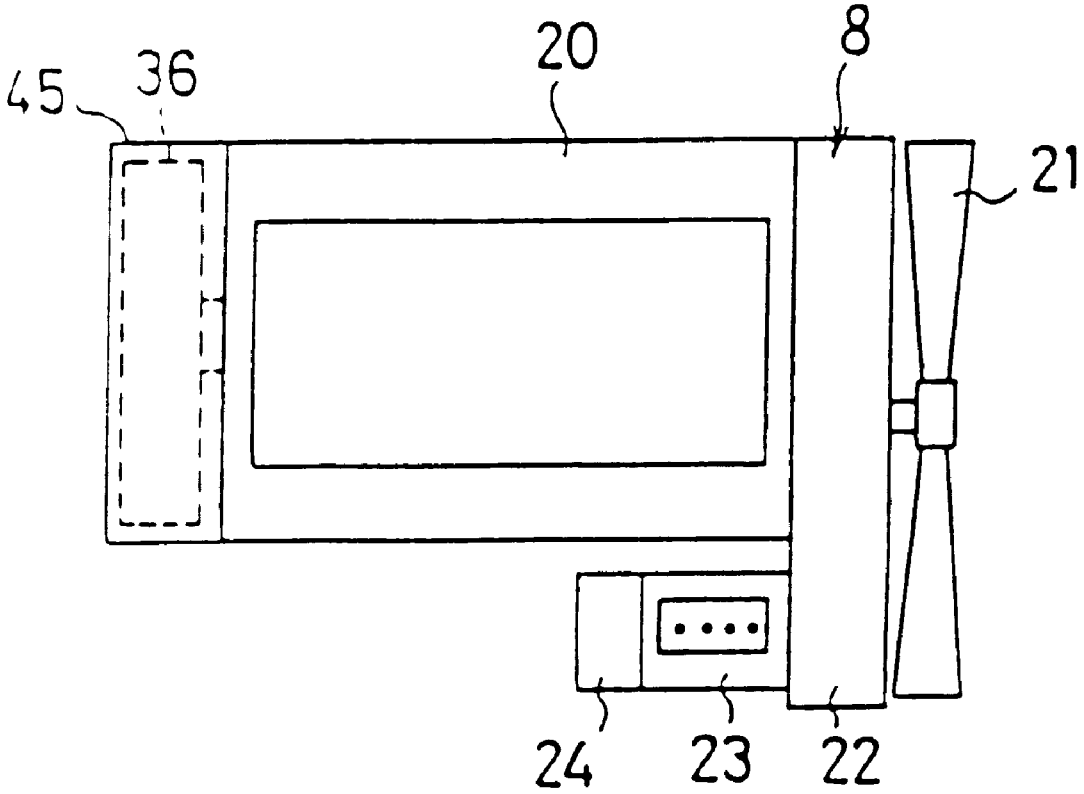
FIG. 3 is a plan view of an engine to which the fuel injection device manufactured according to the first embodiment of the present invention is attached.

In order to enable the pump case 1 connected to the timing gear case 8 to turn about the fuel injection cam shaft 3, as shown in FIG. 2, the connecting portion 5 is formed annularly, with the input end portion 6 of the fuel injection cam shaft 3 projected from the center portion, so that the connecting portion 5 can be fitted rotatably into the circular fitting hole 32 of the timing gear case 8, as shown in FIG. 1(A). In order to enable the pump case 1 which has stopped its revolution to be fixed to the timing gear case 8, a shown in FIG. 2(B), arcuate elongated holes 34 are formed in the end wall 4 of the pump case 1 around the fuel injection cam shaft 3. As shown in FIG. 1(A), the pump case 1 is fixedly secured to the timing gear case 8 by attaching bolts 33 passing through these elongate holes 34.

The method for attaching the fuel injection device 23 to the engine is as follows.

First, as shown in FIG. 1(B), the revolution of the fuel injection cam shaft 3 is temporarily stopped and the revolution of a crankshaft 17 is temporarily stopped.

When temporarily stopping the revolution of the fuel injection cam shaft 3, the fuel injection cam shaft 3 is temporarily held with the pump case 1 in a predetermined position by bringing leading ends of the pair of male screw rods 37*a*, 37*b* into contact with the fuel injection cam shaft 3 to prevent the forward revolution 3*a* of the fuel injection cam shaft 3 by male screw rod 37*a* and the reverse revolution 3*b* by male screw rod 37*b*.

When temporarily stopping the revolution of the crankshaft 17, the crankshaft 17 is temporarily held with the engine in a predetermined position by a pressing bolt 39.

The pump case 1 is connected at its connecting portion 5 to the engine timing gear case 8. The fuel injection cam gear 7 is fixed to the input end portion 6 of the fuel injection cam shaft 3 in a predetermined position and the fuel injection cam gear 7 is engaged with an interlocking gear 16 of a crankshaft gear 15 in a predetermined position.

The pump case 1 connected to the timing gear case 8 is turned about the fuel injection cam shaft 3 in the same direction 19 as the reverse revolution 3*b*. The turning of the pump case 1 is stopped when the play between the gear elements of timing gear train 43, including the crankshaft gear 15, idler gear 16 and fuel injection can gear 7, is removed; then the pump case 1 is fixedly secured in that stopped position to the timing gear case 8.

The temporary stopping of the revolution of the fuel injection cam shaft 3 and the revolution of the crankshaft 17 is terminated.

Details of the above-mentioned method are as follows.

When temporarily stopping the revolution of the fuel injection cam shaft 3, the position of the fuel injection cam shaft 3 is finely adjusted after a preparatory adjustment of the position of the fuel injection cam shaft (3).

When performing the preparatory adjustment of the position of the fuel injection cam shaft 3, the position of the fuel injection cam shaft 3 approaches the predetermined position by turning the fuel injection cam shaft 3 with leading ends of the pair of male screw rods 37*a*, 37*b* separated from the fuel injection cam shaft 3.

When finely adjusting the position of the fuel injection cam shaft 3, the leading ends of the pair of male screw rods 37*a*, 37*b* are brought into contact with the fuel injection cam shaft 3 and the position of the fuel injection cam shaft 3 is detected.

If the detected position of the fuel injection cam shaft 3 deviates form the predetermined position in the direction of the forward revolution 3*a*, the position of the fuel injected cam shaft 3 is rotated in the direction of the reverse revolution 3*b* until the fuel injection cam shaft 3 is received by the male screw rod 37*b*, adapted to prevent the reverse revolution 3*b*, by threadably moving the other male screw rod 37*a* toward the fuel injection cam shaft 3 after having threadably moved the male screw rod 37*b* away from the fuel injection cam shaft 3.

If the detected position of the fuel injection cam shaft 3 deviates from the predetermined position in the direction of the reverse revolution 3*b*, the position of the fuel injection cam shaft 3 is rotated in the direction of the forward revolution 3*a* until the fuel injection cam shaft 3 is received by the male screw rod 37*a*, adapted to prevent the forward revolution 3*a*, by threadably moving the male screw rod 37*b* toward the fuel injection cam shaft 3 after having threadably moved the male screw rod 37*a* away from the fuel injection cam shaft 3. The predetermined position of the fuel injection cam shaft 3 in this embodiment is defined as the position shown in FIG. 2(B). More specifically, it is a position where the key groove 27 is rotated by an angle 48, in the direction of the forward revolution 3*a* of the fuel injection cam shaft 3, from a plunger axis 47 of the fuel injection pump 2.

When performing the preparatory adjustment of the position of the fuel injection cam shaft 3, as shown in FIG. 2(A), the fuel injection cam shaft 3 is preferably turned by a step motor 41. The position of the fuel injecting cam shaft 3 is detected by a rotary encoder disposed within the step motor 41.

As shown in FIG. 1(B), the crankshaft 17 is temporarily held by threadably passing the pressing bolt 39 through the flywheel cover 45 and bringing the leading end of this pressing bolt 39 into contact with the flywheel 36. The position of the crankshaft 17 can be measured by measuring a position of a piston by a dial gauge or the like. Further, it is also possible to specifically measure it by reading out a crank angle with reference to a graduation 44 of the flywheel 36 indicated by a pointer 46 of the flywheel cover 45. The gears of the timing gear train 43 are mutually engaged with one another by coinciding marks 1 4 of respective gears.

The temporary holding of the fuel injection cam shaft 3 is terminated by pulling out the pair of male screw rods 37*a*, 37*b* from the pump case 1. Tapped holes are closed by plugs after the pulling out of the pair of male screw rods 37*a*, 37*b*. The temporary holding of the crankshaft 17 is terminated by pulling out the pressing bolt 39 from the flywheel cover 45. Tapped hole is closed by the plug after the pulling out of the pressing bolt 39.

The above-mentioned method functions as follows.

According to the above-mentioned method, since the fuel injection cam shaft 3 is temporarily held with the pump case 1 before the pump case 1 is connected to the timing gear case 8, it is possible to temporarily hold the fuel injection cam shaft 3 and to set the temporary holding position accurately with the pump case 1 secured by a jig or the like.

Since the forward and reverse revolutions 3*a*, 3*b* of the fuel injection cam shaft 3 are prevented by the pair of male screw rods 37*a*, 37*b*, respectively, the temporarily held position of the fuel injection cam shaft 3 can be maintained reliably. Further, since the position of the crankshaft 17 can be defined accurately by measuring the piston position, etc., the position of the crankshaft 17 to be temporarily held can be set accurately.

It is possible to remove the play within the timing gear train 43 by merely turning the pump case 1 in the same direction 19 as the reverse revolution 3*b* of the fuel injection cam shaft 3. At this time, though a reaction force having the same direction as the forward revolution 3*a* is imposed on the fuel injection cam shaft 3, the temporarily held position of the fuel injection cam shaft 3 does not deviate because the reaction force is received by the male screw rod 37*a* adapted to prevent the forward revolution 3*a*.

In the above-mentioned method, after the fuel injection cam shaft 3 and the crankshaft 17 have been temporarily held in the predetermined positions, the pump case 1 is connected to the timing gear case 8 and the engagement of the timing gear train 43 is performed. Then, the injection start timing is set by merely turning the pump case 1. Since the temporarily holding of the fuel injection cam shaft 3 is carried out before the connection of the pump case 1 to the timing gear case 8, the injection start timing setting can be accomplished separately from the engine assembly. Other tasks can be accomplished in a comparatively short time during the engine assembly.

The advantages of the above-mentioned method are as follows.

According to the above-mentioned method, the position of the fuel injection cam shaft 3 to be temporarily held can be set accurately and its position can be maintained reliably. Also the position of the crankshaft 17 to be temporarily held can be set accurately. Further, the play in the timing gear train 43 is removed to prevent the temporarily held position of the fuel injection cam shaft 3 from deviating. For these reasons, the fuel injection timing can be set accurately by the above-mentioned method.

According to the above-mentioned method, the temporary holding of the fuel injection cam shaft 3 during the injection start timing setting allows the setting of the injection start timing to be accomplished separately from the engine assembly. Thus, other tasks can be accomplished in a comparatively short time. Therefore, the engine assembly doesn't stagnate.

According to the above-mentioned method, since the position of the fuel injection cam shaft 3 is finely adjusted after the preliminary or preparatory adjustment thereof, the position of the fuel injection cam shaft 3 to be temporarily held can be set accurately. Therefore, the fuel injection timing can be set accurately.

According to the above-mentioned method, the position of the fuel injection cam shaft 3 can be finely adjusted by threadably operating the pair of male screw rods 37*a*, 37*b*. Therefore, the pair of male screw rods 37*a*, 37*b* comprising the temporary holding means for the fuel injection cam shaft 3 can also be used effectively as a fine adjusting means for the position of the fuel injection cam shaft 3.

According to the above-mentioned method, when preliminarily adjusting the position of the fuel injection cam shaft 3, the fuel injection cam shaft 3 can be turned by a step motor 41. Therefore, the preliminary adjustment can be accomplished quickly and accurately.

According to the above-mentioned method, the position of the fuel injection cam shaft 3 is finely adjusted by the pair of male screw rods 37*a*, 37*b* after the preliminary adjustment by the step motor 41. Therefore, it is unnecessary to use a step motor capable of positioning with high accuracy.

The advantage of the above-mentioned device is as follows.

According to the above-mentioned device, since the pair of male screw rods 37*a*, 37*b* pass through the wall 11 of the pump case 1 on one of its lateral sides, the threading operation can be readily carried out on one of the lateral sides of the pump case 1.

Figure 4A:
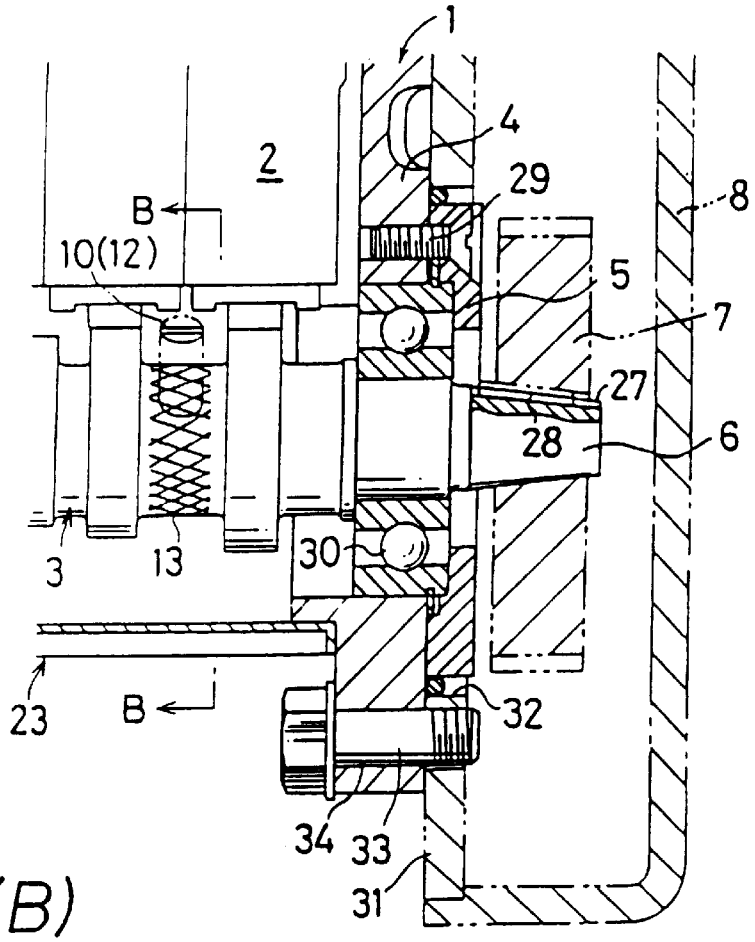
FIG. 4(A) is a vertical sectional view of a principal portion of the fuel injection device attached to a timing gear case and FIG. 4(B) is a sectional view taken along the B—B line in FIG. 4(A)
Figure 4B:
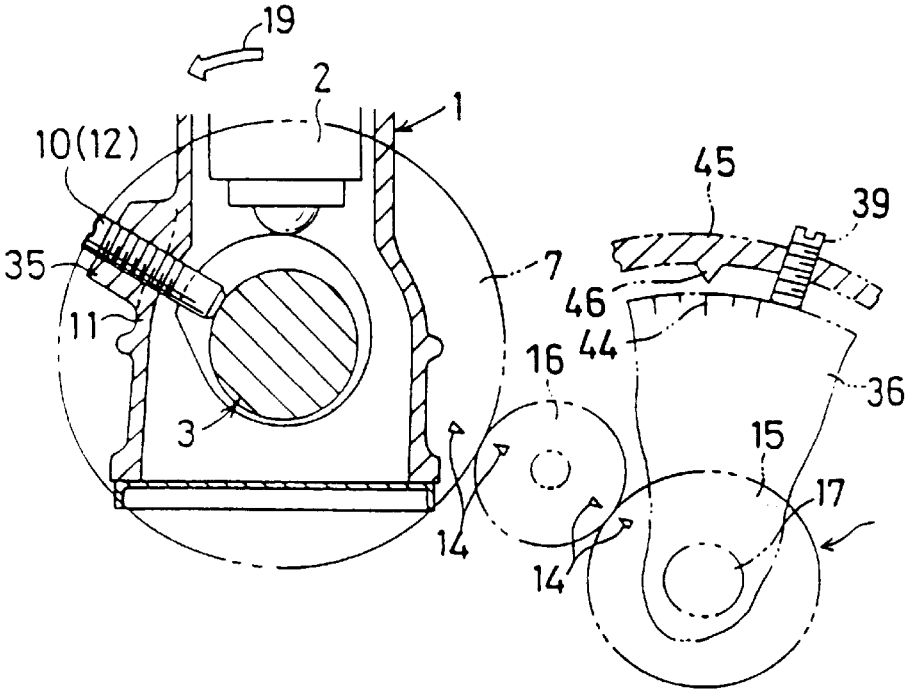
Figure 5A:
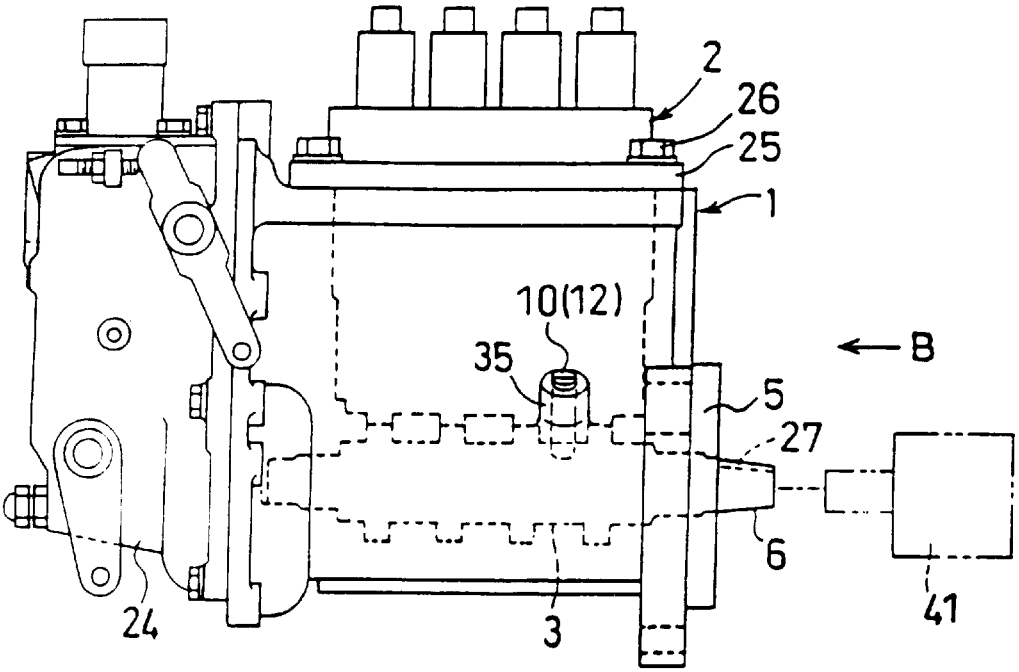
FIG. 5(A) is a side view of the fuel injection device and FIG. 5(B) is a front view of the fuel injection device.
Figure 5B:
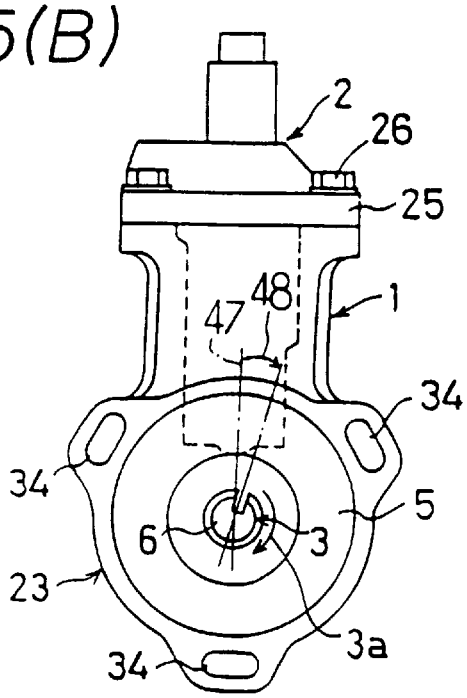
Figure 6:
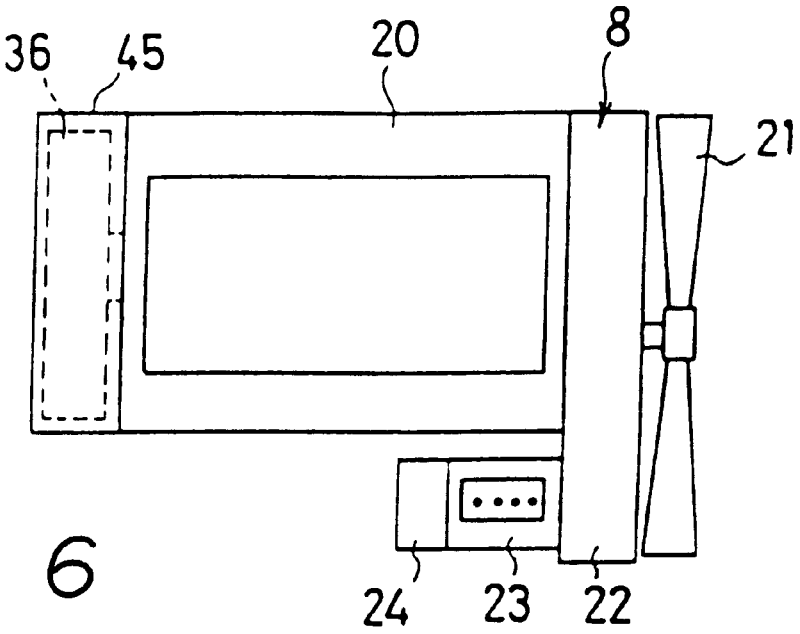
FIG. 6 is a plan view of an engine to which the fuel injection device manufactured according to the second embodiment of the present invention is attached.

FIGS. 4 through 6 are views of a second embodiment of the present invention. This second embodiment also relates to a fuel injection device and a method for attaching this device to an engine.

Features different from those of the device in the first embodiment are as follows.

Though the pair of male screw rods 37*a*, 37*b* comprise the temporary holding means 10 in the first embodiment, a single male screw rod 12 comprises the temporary holding means 10 in the second embodiment.

In the device of the first embodiment, the engagement block 38 in the shape of a rectangular parallel-piped is formed in the fuel injection cam shaft 3 and the leading ends of the pair of male screw rods 37*a*, 37*b* are brought into contact with the pair of locations 38*a*, 38*b* positioned at the opposite end portions of the flat surface 38*c* of this engagement block 38. The forward revolution 3*a* of the fuel injection cam shaft 3 is prevented by one male screw rod 37*a* and the reverse revolution 3*b* is prevented by the other male screw rod 37*b* so that the fuel injection cam shaft 3 can be temporarily held in the predetermined position with the pump case 1. On the other hand, in the device of the second embodiment, a leading end of the single male screw rod 12 is brought into contact with a cylindrical surrounding surface of the fuel injection cam shaft 3 to frictionally secure the fuel injection cam shaft 3 by the leading end of the male screw rod 12 so that the fuel injection cam shaft 3 can be temporarily held in a predetermined position with the pump case 1.

Figure 7:
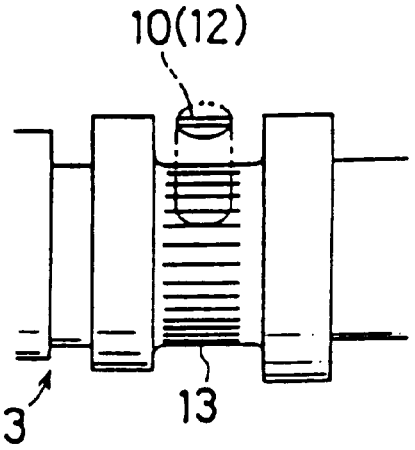
FIG. 7 is a partial view of a principal portion of a modified example of the second embodiment of the present invention.
Figure 8A:
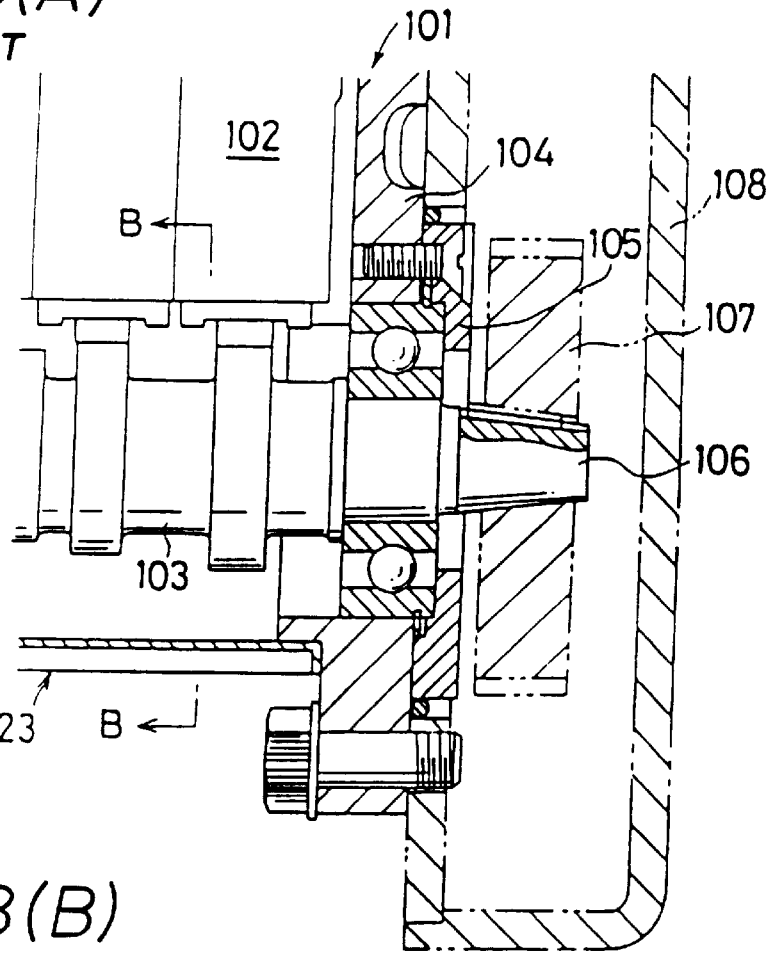
FIG. 8(A) PRIOR ART
FIG. 8(A) is a vertical sectional view of a principal portion of the fuel injection device attached to a timing gear case and FIG. 8(B) is a sectional view taken along the B—B line in FIG. 8(A).
Figure 8B:
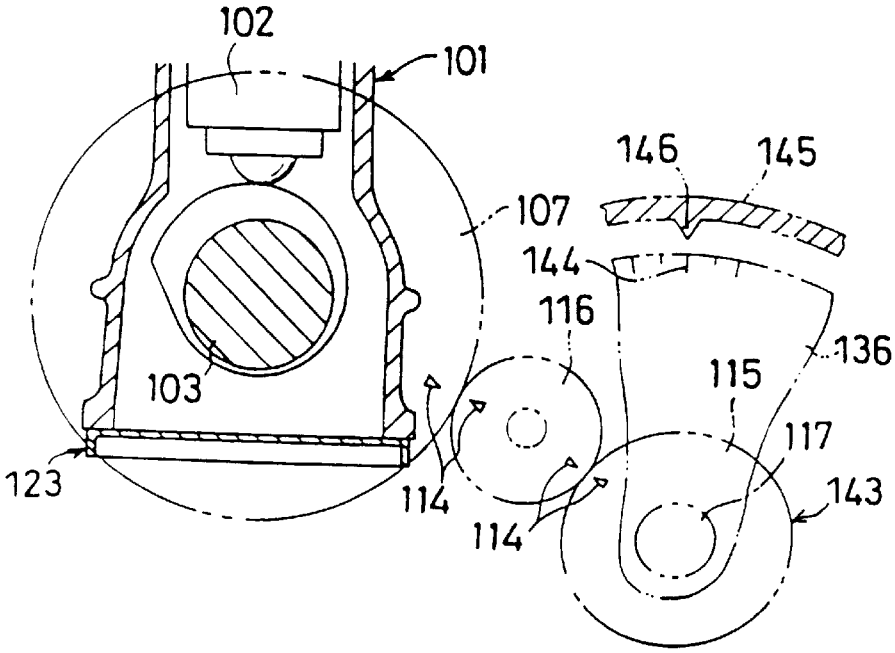
FIG. 8(B) PRIOR ART

Incidentally, knurls as an antislipping means 13 may be formed in the cylindrical surrounding surface of the fuel injection cam shaft 3 for contact with the leading end of the male screw rod 12. In a modified example of the second embodiment shown in FIG. 7, a plurality of axial grooves as the antislipping means 13 are formed in the cylindrical surrounding surface of the fuel injection cam shaft 3.

A point different from that of the method in the first embodiment is as follows.

Though the position of the fuel injection cam shaft 3 is finely adjusted by the pair of male screw rods 37*a*, 37*b* in the first embodiment, such fine adjustment can't be made in the second embodiment.

Other constructions in the device and the method of the second embodiment are the same as those of the first embodiment. In FIGS. 4 through 6,the same component members are designated by the same symbols as those in the first embodiment.

What is claimed is:

1. A method for attaching a fuel injection device to an engine, the engine including a crankshaft (17) with a crankshaft gear (15) and a timing gear train (43), including meshed gears (15, 16, 17) extending from the crankshaft gear (15) to a fuel injection cam gear (7), the timing gear train (43) located within an engine timing gear case (8) and including play between the meshed gears, the fuel injection device (23) being adapted to be attached to the engine and including a pump case (1), a fuel-injection pump (2) fixably secured to the pump case (1), the pump case (1) having an end wall (4) in which a connecting portion (5) is arranged, a fuel injection cam shaft (3) bridged within the pump case (1), the fuel injection cam shaft (3) having an input end portion (6) projecting from the connecting portion (5), and a holding means (10) comprising at least one male screw rod arranged in the pump case (1), the method comprising the steps of:

stopping a revolution of the fuel injection cam shaft (3);

stopping a revolution of the crankshaft (17);

holding the fuel injection cam shaft (3) with the pump case (1) in a predetermined position by preventing a forward revolution (3*a*) and a reverse revolution (3*b*) of the fuel injection cam shaft (3) by the holding means (10) comprising at least one male screw rod, when stopping the revolution of the fuel injection cam shaft (3);

holding the crankshaft (17) with the engine in a predetermined position by a mechanical means, when stopping the revolution of the crankshaft (17);

connecting the pump case (1) at connecting portion (5) to the engine timing gear case (8), fixing the fuel injection cam gear (7) to the input end portion (6) of the fuel injection cam shaft (3) in a predetermined position, and engaging the fuel injection cam gear (7) with the crankshaft gear (15) in a predetermined position;

turning the pump case (1) connected to the timing gear case (8) about the fuel injection cam shaft (3) in the same direction (19) as the reverse revolution (3*b*), and then stopping the turning of the pump case (1) and fixably securing the pump case (1) to the timing gear case (8) after the play in the timing gear train (43) has been removed; and releasing the fuel injection cam shaft (3) and the crankshaft (17) for rotation.

2. The method for attaching a fuel injection device to an engine according to claim 1, wherein the holding means (10) comprises a pair of male screw rods (37*a*,37*b*) which are threadably moveably passed through a wall (11) of the pump case (1), and wherein the step of holding the fuel injection cam shaft (3) comprises the steps of:

bringing a leading end of one of the male screw rods (37*a*) into contact with the fuel injection cam shaft (3) to prevent the forward revolution (3*a*) of the fuel injection cam shaft (3); and bringing a leading end of the other male screw rod (37*b*) into contact with the fuel injection cam shaft (3) to prevent the reverse revolution (3*b*) of the fuel injection cam shaft (3).

3. A method for attaching a fuel injection device to an engine according to claim 2, wherein the step of holding the fuel injection cam shaft (3) further comprises the steps of:

performing a preparatory adjustment of the position of the fuel injection cam shaft (3) by turning the fuel injection cam shaft (3) with the leading ends of the pair of male screw rods (37*a*, 37*b*) separated from the fuel injection cam shaft (3) to approach the position of the fuel injection cam shaft (3) to the predetermined position; and finely adjusting the position of the fuel injection cam shaft (3) after the preparatory adjustment of the position of the fuel injection cam shaft (3) by bringing the leading ends of the pair of male screw rods (37*a*, 37*b*) into contact with the fuel injection cam shaft (3) and detecting the position of the fuel injection cam shaft (3);

wherein when the detected position of the fuel injection cam shaft (3) deviates from the predetermined position in the direction of the forward revolution (3*a*), the position of the fuel injection cam shaft (3) is rotated in the direction of the reverse revolution (3*b*) until the fuel injection cam shaft (3) is contacted by one of the male screw rods (37*b*) by threadably moving the other of the male screw rods (37*a*) toward the fuel injection cam shaft (3) after having threadably moved the one of the male screw rods (37*b*) away from the fuel injection cam shaft (3); and wherein when the detected position of the fuel injection cam shaft (3) deviates from the predetermined position in the direction of the reverse revolution (3*b*), the position of the fuel injection cam shaft (3) is rotated in the direction of the forward revolution (3*a*) until the fuel injection cam shaft (3) is contacted by one of the male screw rods (37*a*) by threadably moving the other of the male screw rods (37*b*) toward the fuel injection cam shaft (3) after having threadably moved the one of the male screw rods (37*a*) away from the fuel injection cam shaft (3).

4. A method for attaching a fuel injection device to an engine according to claim 3, wherein the step of performing the preparatory adjustment of the position of the fuel injection cam shaft (3) further comprises the step of:

actuating a step motor (41) to accomplish the turning of the fuel injection cam shaft (3).

5. A method for attaching a fuel injection device to an engine, the engine including a crankshaft (17) with an interlocking gear (16) of a crankshaft gear (15) and a timing gear train (43), including meshed gears (15, 16, 17) extending from the crankshaft gear (15) to a fuel injection cam gear (7), the timing gear train (43) located within an engine timing gear case (8) and including play between the meshed gears, the fuel injection device (23) being adapted to be attached to the engine and including a pump case (1), a fuel-injection pump (2) fixably secured to the pump case (1), the pump case (1) having an end wall (4) in which a connecting portion (5) is arranged, a fuel injection cam shaft (3) bridged within the pump case (1), the fuel injection cam shaft (3) having an input end portion (6) projecting from the connecting portion (5), and a holding means (10) comprising at least one male screw rod arranged in the pump case (1), the method comprising the steps of:

stopping a revolution of the fuel injection cam shaft (3);

stopping a revolution of the crankshaft (17);

holding the fuel injection cam shaft (3) with the pump case (1) in a predetermined position by preventing a forward revolution (3*a*) and a revolution (3*b*) of the fuel injection cam shaft (3) by the holding means (10) comprising at least one male screw rod, when stopping the revolution of the fuel injection cam shaft (3);

holding the crankshaft (17) with the engine in a predetermined position by a mechanical means, when stopping the revolution of the crankshaft (17);

connecting the pump case (1) at the connecting portion (5) to the engine timing gear case (8), fixing the fuel injection cam gear (7) to the input end portion (6) of the fuel injection cam shaft (3) in a predetermined position, and engaging the fuel injection cam gear (7) with the interlocking gear (16) of the crankshaft gear (15) in a predetermined position;

turning the pump case (1) connected to the timing gear case (8) about the fuel injection cam shaft (3) in the same direction (19) as the reverse revolution (3*b*), and then stopping the turning of the pump case (1) and fixably securing the pump case (1) to the timing gear case (8) after the play in the timing gear train (43) has been removed; and releasing the fuel injection cam shaft (3) and the crankshaft (17) for rotation.

6. The method for attaching a fuel injection device to an engine according to claim 5, wherein the holding means (10) comprises a pair of male screw rods (37*a*,37*b*) which are threadably moveably passed through a wall (11) of the pump case (1), and wherein the step of holding the fuel injection cam shaft (3) comprises the steps of:

bringing a leading end of one of the male screw rods (37*a*) into contact with the fuel injection cam shaft (3) to prevent the forward revolution (3*a*) of the fuel injection cam shaft (3); and bringing a leading end of the other male screw rod (37*b*) into contact with the fuel injection cam shaft (3) to prevent the reverse revolution (3*b*) of the fuel injection cam shaft (3).

7. The method for attaching a fuel injection device to an engine according to claim 6, wherein the step of holding the fuel injection cam shaft (3) further comprises the steps of:

performing a preparatory adjustment of the position of the fuel injection cam shaft (3) by turning the fuel injection cam shaft (3) with the leading ends of the pair of male screw rods (37*a*, 37*b*) separated from the fuel injection cam shaft (3) to approach the position of the fuel injection cam shaft (3) to the predetermined position; and finely adjusting the position of the fuel injection cam shaft (3) after the preparatory adjustment of the position of the fuel injection cam shaft (3) by bringing the leading ends of the pair of male screw rods (37*a*, 37*b*) into contact with the fuel injection cam shaft (3) and detecting the position of the fuel injection cam shaft (3);

wherein when the detected position of the fuel injection cam shaft (3) deviates from the predetermined position in the direction of the forward revolution (3*a*), the position of the fuel injection cam shaft (3) is rotated in the direction of the reverse revolution (3*b*) until the fuel injection cam shaft (3) is contacted by one of the male screw rods (37*b*) by threadably moving the other of the male screw rods (37*a*) toward the fuel injection cam shaft (3) after having threadably moved the one of the male screw rods (37*b*) away from the fuel injection cam shaft (3); and wherein when the detected position of the fuel injection cam shaft (3) deviates from the predetermined position in the direction of the reverse revolution (3*b*), the position of the fuel injection cam shaft (3) is rotated in the direction of the forward revolution (3*a*) until the fuel injection cam shaft (3) is contacted by one of the male screw rods (37*a*) by threadably moving the other of the male screw rods (37*b*) toward the fuel injection cam shaft (3) after having threadably moved the one of the male screw rods (37*a*) away from the fuel injection cam shaft (3).

8. The method for attaching a fuel injection device to an engine according to claim 7, wherein the step of performing the preparatory adjustment of the position of the fuel injection cam shaft (3) further comprises the step of:

actuating a step motor (41) to accomplish the turning of the fuel injection cam shaft (3).

9. A fuel injection device adapted to be attached to an engine having a timing gear case (8), the fuel injection device comprising:

a pump case (1) with an end wall (4), the pump case (1) having a connecting portion (5) arranged in the end wall (4), the pump case (1) being rotatably connected at connecting portion (5) to the engine timing gear case (8);

a fuel injection pump (2) fixably secured to the pump case (1);

a fuel injection cam shaft (3) spanning the pump case (1), the fuel injection cam shaft (3) having an input end portion (6) projecting from the connecting portion (5); and a holding means (10) comprising at least one male screw rod arranged in the pump case (1);

wherein the fuel injection cam shaft (3) is received by the pump case (1) in a predetermined position with the holding means (10) preventing a forward revolution (3*a*) and a reverse revolution (3*b*) of the fuel injection cam shaft (3) and a fuel injection cam gear (7) is fixedly secured to the input end portion (6) of the fuel injection cam shaft (3) in a predetermined position, the pump case (1) being fixedly secured to the timing gear case (8) after being turned about the fuel injection cam shaft (3) to a desired position.

10. The fuel injection device adapted to be attached to an engine according to claim 9, wherein the holding means (10) comprises a pair of male screw rods (37*a*, 37*b*) which are threadably moveably passed through a wall (11) of the pump case (1), the male screw rods (37*a*, 37*b*) having leading ends which are brought into contact with the fuel injection cam shaft (3) to prevent the forward revolution (3*a*) of the fuel injection cam shaft (3) by one of the male screw rods (37*a*) and to prevent the reverse revolution (3*b*) by the other male screw rod (37*b*).

11. The fuel injection device adapted to be attached to an engine according to claim 10, wherein the wall (11) through which the pair of male screw rods (37*a*, 37*b*) are passed is on a lateral side of the pump case (1).

* * * * *